United States Patent [19]

Mayer et al.

[11] 3,987,511

[45] Oct. 26, 1976

[54] DEVICE FOR SEPARATING CYLINDRICAL SCREEN STENCIL FROM AN INK TUBE AND WASHING THE STENCIL

[76] Inventors: Karl Mayer, Ernst-Wlattniggasse 17; Friedrich Kampitsch, Fischlstrasse 27/6, both of A-9010 Klagenfurt; Helmut Frey, Ressnigweg 34, A-9170 Ferlach; Friedrich Letschnig, J.F.Perkonig-Gasse 16a, A-9010 Klagenfurt, all of Austria

[22] Filed: Nov. 19, 1975

[21] Appl. No.: 633,547

Related U.S. Application Data

[63] Continuation-in-part of Ser. No. 521,944, Nov. 7, 1974, abandoned.

[30] Foreign Application Priority Data

Nov. 9, 1973 Austria ..... 9479/73

[52] U.S. Cl. ..... 15/21 D; 15/57; 15/88

[51] Int. Cl.[2] ..... A46B 13/06

[58] Field of Search ..... 15/4, 21 R, 21 D, 56, 15/57, 58, 88, 97, 101, 104.1 R, 104.1 C, 104.16, 104.2

[56] References Cited

UNITED STATES PATENTS

| | | | |
|---|---|---|---|
| 2,152,036 | 3/1939 | Froh | 15/88 |
| 2,267,435 | 12/1941 | Thomas | 15/88 X |
| 2,558,983 | 7/1951 | Roberts | 15/57 |

*Primary Examiner*—Charles E. Phillips
*Attorney, Agent, or Firm*—Wenderoth, Lind & Ponack

[57] ABSTRACT

A frame has an inclined surface over which slides a carriage having a pair of screen mounting elements for supporting opposite screen ends of a stencil. A washing tube having spray nozzles and a brush is fixedly positioned such that movement of the carriage brings a stencil carried thereby to a position over the washing tube. An ink tube has one end supported by the washing tube and another end supported by the frame, such that movement of the carriage separates the stencil from the ink tube.

10 Claims, 1 Drawing Figure

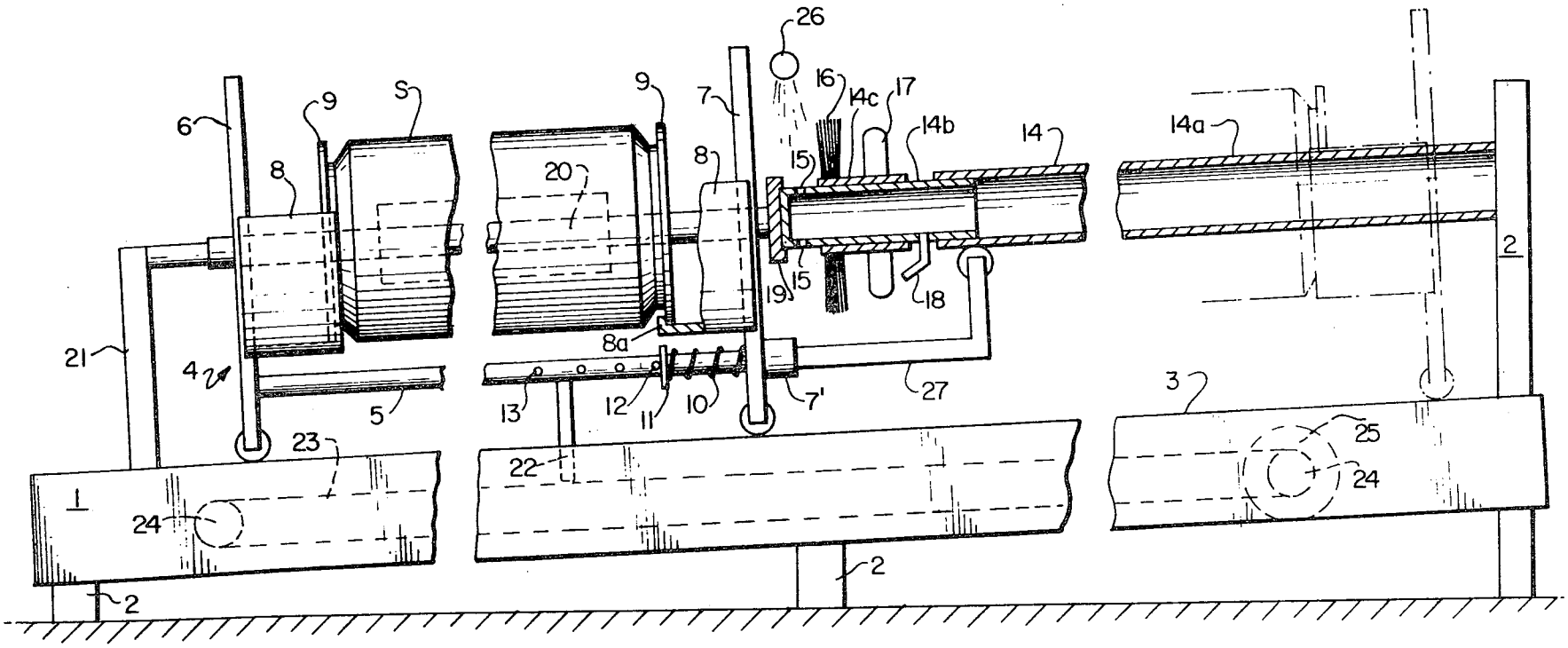
2
14a
3
25
24
14
14b
17
14c
16
26
15
15
19
18
27
7'
7
8
9
20
8a
10
11
12
13
22
2
5
5
9
8
6
4
23
24
21
2

DEVICE FOR SEPARATING CYLINDRICAL SCREEN STENCIL FROM AN INK TUBE AND WASHING THE STENCIL

This is a continuation-in-part of application Ser. No. 521,944, filed Nov. 7, 1974 now abandoned.

BACKGROUND OF THE INVENTION

The present invention relates to a device for separating a cylindrical stencil from an interiorly positioned ink tube and for thereafter washing and cleaning the cylindrical stencil.

There have become known extremely large, and particularly relatively long, cylindrical screen stencils in the printing industry. During operation, such cylindrical screen stencils have extending therethrough an ink tube which is somewhat longer than the cylindrical screen stencil. Periodically it is necessary to dismantle the cylindrical screen stencils and ink tubes so that they may be washed and cleaned. Such operation has in the past been quite cumbersome due to the size of the cylindrical stencils and ink tubes and thus causes soiling and spillage. Additionally, the disassembly of the ink tube from the screen stencil involves a certain amount of danger of damaging the fragile stencil due to the length of the elements and due to the fact that the elements are thus difficult to handle.

In the past, there have been known devices designed to mechanically separate the stencil from the ink tube and thereafter wash and clean the stencil. However, all such known devices have failed to be completely satisfactory.

SUMMARY OF THE INVENTION

With the above discussion in mind, it is the primary object of the present invention to provide an improved device for separating a cylindrical screen stencil from an interiorly positioned ink tube and for thereafter washing and cleaning the stencil.

It is a further object of the present invention to provide such a device which is simple both in construction and operation.

It is a yet further object of the present invention to provide such a device which substantially eliminates both spillage of ink and the possibility of damage to the cylindrical screen stencil.

The above objects are achieved in accordance with the present invention by the provision of a device which includes a frame having an inclined upper surface on which ride a movable carriage. The frame includes a drive system for moving the carriage back and forth along the inclined surface of the frame. The carriage includes mounting elements which are capable of adjustment and which support a cylindrical screen stencil. Supported above the frame and extending along the path of movement of the carriage is a washing tube through which may be supplied washing liquid, such as water, and which will supply the water through nozzles to the interior of the screen stencil as it is moved over the washing tube. The washing tube also may include a rotary brush to further facilitate cleaning of the interior of the cylindrical stencil.

The present invention further includes the provision of a coupling arrangement for attaching one end of an ink tube to a free end of the washing tube. The other end of the ink tube is supported by an ink tube support on the frame.

The cylindrical screen and ink tube may be removed from a printing machine in a conventional manner and positioned in the device of the invention such that the carriage mounting elements support the end pieces of the screen and such that the ink tube is supported at one end thereof by the washing tube and at the other end thereof by the ink tube support. Thereafter, the drive system is operated to move the carriage, thereby moving the cylindrical stencil over the washing tube, and simultaneously separating the cylindrical stencil from the ink tube. At the same time, washing liquid, such as water, is supplied to the interior of the washing tube and passes through nozzles in the washing tube against the interior of the cylindrical screen. Additionally, the washing tube may include a rotary brush to contact and further clean the interior of the cylindrical stencil as it moves over the washing tube.

BRIEF DESCRIPTION OF THE DRAWING

Other objects and features of the present invention will be apparent from the following detailed description, taken together with the accompanying drawing, wherein:

The single FIGURE is an elevation view, partially schematic and partially in section, illustrating the cylindrical stencil separating and cleaning device of the present invention.

DETAILED DESCRIPTION OF THE INVENTION

The cylindrical stencil separating and washing device of the present invention includes a frame 1 supported in any suitable manner, such as by columns 2. Positioned to move along the upper surface 3 of frame 1 is a sliding carriage 4 including generally horizontal and longitudinally extending support members 5 and generally vertically extending supports 6 and 7. Upper surface 3 is preferably inclined to avoid the possibility of the formation of an accumulation of washing liquid within the stencil, since such an accumulation might damage the stencil. At least one of vertical supports 6 or 7 is movable mounted on longitudinal supports 5. Specifically, in the drawing, vertical support 7 has attached thereto collars 7' which are slidable over longitudinal supports 5.

Suitably supported by vertical supports 6 and 7 are screen mounting elements 8. These elements may be any suitable elements which are capable of supporting cylindrical screen stencil S. In the illustrated embodiment, mounting elements 8 have lips 8*a* which are capable of fitting against and supporting conventional screen ends 9.

The vertical support 7, which is longitudinally movable with respect to longitudinal supports 5, is biased longitudinally away from the other vertical support 6, for instance by means of springs 10 which act between vertical support 7 and plates or rings 11 which are fixedly positioned with respect to longitudinal supports 5. Thus, vertical support 7, and thereby the respective screen mounting element 8, is urged away from the other vertical support 6 and its respective screen mounting element, thereby supporting and tensioning cylindrical screen stencil S.

Plates or rings 11 may be adjustably positioned longitudinally of supports 5 by means of pins or keys 12 and suitably complementary shaped recesses or openings 13. For purposes of clarity, the drawing illustrates only one longitudinal support 5, and thus only one of spring 10, ring 11 and key 12.

Suitably supported above one end of frame 1, for instance by one of the columns 2, is a washing tube 14 which extends parallel to the upper surface 3 of frame 1 along the path of movement of carriage 4. Specifically, the right hand end of washing tube 14, as viewed in the figure, is provided with washing liquid, such as water, supply means to thereby supply washing liquid to the interior of washing tube 14.

In the illustrated embodiment, washing tube 14 includes main section 14*a* as well as end section 14*b* fitted into the free end of section 14*a*. End section 14*b* has rotatably mounted thereabout a sleeve 14*c* which carries thereon a brush 16 which is capable of rotating against the interior of the cylindrical screen stencil S, as well as a sleeve motive means, such as turbine 17. End section 14*b* has extending therefrom a nozzle 18 through which washing liquid is directed from the interior of washing tube 14 against turbine 17, to thereby rotate sleeve 14*c* and thus brush 16. Washing tube 14 also has extending therethrough, nozzle openings 15 through which washing liquid is forced from the interior of washing tube 14. Nozzle openings 15 may be suitably located at various locations as desired.

Furthermore, at the free end of washing tube 14, such as at the free end of end section 14*b*, there is provided coupling blocking member 19 for supporting and blocking one end of ink tube 20. An ink tube support 21 is supported by frame 1 in a position to support and block the other end of ink tube 20.

Extending downwardly from carriage 4 is an arm 22 which is engageable with and carryable by a chain or belt 23 which is moved in a reversible direction by means of sprockets or pulleys 24 by means such as a reversible motor 25.

It is believed that the operation of the device of the present invention will be apparent from the above description. However, the operation of the device will be briefly summarized below.

Initially, cylindrical screen stencil S and ink tube 20 are removed from a printing machine, for instance manually or by known removal structures, which are not shown for purposes of clarity since they form no portion of the present invention.

The thus removed cylindrical screen stencil S and ink tube 20 are then positioned in the device of the present invention with end pieces 9 of the cylindrical screen stencil positioned in lips 8*a* of screen supports 8. The position of movable vertical support 7 is adjusted by means of plates 11, keys 12 and recesses 13 to the desired length of the cylindrical screen stencil S. Spring 10 thus urges vertical supports 6 and 7 apart such that the cylindrical screen stencil S is supported.

Simultaneously, the opposite ends of ink tube 20 are fitted in coupling device 19 and support 21.

Thereafter, motor 25 is operated to move the upper run of chain or belt 23 to the right as viewed in the drawing, to thereby move carriage 4, via arm 22, to the right as viewed in the figure. This action simultaneously moves cylindrical screen stencil S to the right as viewd in the figure, thus separating the cylindrical screen stencil S from ink tube 20 and moving the cylindrical screen stencil over washing tube 14, and specifically over nozzles 15 and brush 16. By this action, the interior of the cylindrical screen stencil S is washed and cleaned.

The cylindrical screen stencil S is eventually moved to a position shown by the phantom lines at the right of the figure. At this position, the ink tube 20 may be removed from the device and separately cleaned. Upon its being separately cleaned, the ink tube 20 may be replaced, and thereafter motor 25 may be reversed to move carriage 4 and cylindrical screen stencil S back to a position with the ink tube 20 positioned therein. Thereafter, the cylindrical screen stencil S and the ink tube 20 may be removed from the device and replaced in the printing machine.

As will be apparent from the drawing, it is also possible to provide a nozzle 26, supported in any convenient (not shown) manner, for spraying washing liquid at the exterior of the cylindrical screen stencil S.

Furthermore, in accordance with the present invention it is possible to provide a support 27, attached to carriage 4, for providing support for washing tube 14.

It will further be apparent that numerous modifications and alterations may be made to the specific structural elements discussed above, without departing from the spirit and scope of the present invention.

What is claimed is:

1. A device for separating a cylindrical screen stencil from an ink tube positioned therein and for washing said stencil, said device comprising:

means for supporting a cylindrical screen stencil having positioned therein an ink tube;

means, separate from said stencil supporting means, for supporting such ink tube;

fixedly positioned stencil washing means; and means, operatively associated with said stencil supporting means, for moving said stencil supporting means, and thus a stencil supported thereby, back and forth from a first position wherein such stencil has an ink tube positioned therein and is spaced from said stencil washing means, to a second position wherein such stencil is separated from the ink tube and is positioned over said stencil washing means, said stencil washing means washing the interior or said stencil as said stencil is moved from said first position to said second position.

2. A device as claimed in claim 1, further comprising a frame having an upper surface; and wherein said stencil supporting means comprise a sliding carriage slidably movable on said upper surface.

3. A device as claimed in claim 2, wherein said upper surface is inclined.

4. A device as claimed in claim 2, wherein said moving means comprises an endless chain or belt mounted on said frame; drive means for reversibly driving said chain or belt; and a connection fixed to said carriage and to said chain or belt.

5. A device as claimed in claim 1, wherein said stencil supporting means comprises a sliding carriage having thereon a pair of screen mounting elements for supporting opposite screen ends of a stencil.

6. A device as claimed in claim 5, further comprising means for adjusting the spacing between said pair of screen mounting elements to thereby adjust the capacity of said carriage to screens of varying size.

7. A device as claimed in claim 1, wherein said stencil washing means comprises a longitudinal washing tube having nozzles therein for spraying washing liquid outwardly against the interior of a stencil when said stencil supporting means moves to said second position.

8. A device as claimed in claim 7, wherein said ink tube supporting means comprises a coupler means on said washing tube for supporting a first end of said ink tube, and an ink tube support for supporting a second end of said ink tube.

9. A device as claimed in claim 7, wherein said stencil washing means further comprises a brush means rotatably mounted about said washing tube for contacting the interior of a stencil when said stencil supporting means moves to said second position.

10. A device as claimed in claim 9, further comprising turbine means on said washing tube for rotating said brush means.

* * * * *